United States Patent [19]

Matsuzaki et al.

[11] 4,236,447

[45] Dec. 2, 1980

[54] PRINTING COLUMN NUMBER LIMITING DEVICE

[75] Inventors: Kazuo Matsuzaki; Shigenobu Katagiri; Hiroshige Nakano, all of Katsuta, Japan

[73] Assignee: Hitachi Koki Co., Ltd., Tokyo, Japan

[21] Appl. No.: 950,109

[22] Filed: Oct. 10, 1978

[30] Foreign Application Priority Data

Oct. 8, 1977 [JP] Japan ..... 52/121239

[51] Int. Cl.[3] ..... B41J 1/20

[52] U.S. Cl. ..... 101/93.14; 101/93.29; 101/93.09; 178/23 R

[58] Field of Search ..... 101/93.29–93.34, 101/93.48, 93.01, 93.09, 93.14; 178/23 R, 21, 25

[56] References Cited

U.S. PATENT DOCUMENTS

| | | | |
|---|---|---|---|
| 3,651,487 | 3/1972 | Washington | 101/93.14 X |
| 3,795,186 | 3/1974 | Curtiss et al. | 101/93.14 |
| 3,872,788 | 3/1975 | Palombo | 101/93.14 |
| 3,921,517 | 11/1975 | Barcomb et al. | 101/93.09 |
| 3,944,741 | 3/1976 | Harris et al. | 178/23 R |
| 3,952,648 | 4/1976 | Sery et al. | 101/93.14 |

OTHER PUBLICATIONS

Blythe et al., "Hammer Firing Control in Belt Printers", IBM Tech. Discl. Bulletin, vol. 20, No. 4, 9/77, pp. 1319–1320.

*Primary Examiner*—Edward M. Coven

*Attorney, Agent, or Firm*—Sughrue, Rothwell, Mion, Zinn and Macpeak

[57] ABSTRACT

A device for limiting the number of printing columns in a printer in which a group of printing data codes transferred from a data source are successively compared with a group of type codes which are determined in correspondence to the instantaneous positions of type on a type carrier, so that a type in a place where a printing data code coincides with a type code is printed. The device comprises a reversible counter adapted to subject a coincidence signal relating to said printing data code and type code and a printing completion signal for each place to addition and subtraction, respectively, so that when the count value of the reversible counter reaches a predetermined value, printing for further places is inhibited.

8 Claims, 5 Drawing Figures

PRINTING COLUMN NUMBER LIMITING DEVICE

BACKGROUND OF THE INVENTION

This invention relates to printers such as line printers, and more particularly to a device for limiting the number of printing columns (hereinafter referred to as "a printing column number limiting device" when applicable) in such a printer.

Printing in a line printer is carried out as follows: A group of printing data codes transferred from a data source are successively compared with a group of type data codes which are determined in correspondence to the instantaneous positions of types on a type carrier. When a printing data code coincides with a type data code position, a printing hammer in the place where the coincidence is obtained is driven for printing of that type.

A group of printing data codes are transferred in various modes from the data source. In a particular mode, a phenomenon may exist where the printing data codes coincide with the type codes for all the printing places within a limited short period of time. This is a "worst case" condition in terms of structual requirements on a system. In this case, the printing hammers for all the printing places are driven collectively within the short period of time. Accordingly, the printer should be provided with a rigid mechanical construction to withstand this collective driving of the printing hammers and have a corresponding large capacity printing hammer driving electric source.

However, in normal operation of the printer, it is rare that a group of printing data codes will be transferred in the aforementioned particular mode from the data source. Therefore, if the mechanical construction and electric source are designed by taking this rare condition into account, then the printer will become considerably more expensive than necessary for ordinary use.

In order to overcome this difficulty in the prior art a technique is provided for a printer in which a group of printing data codes are compared with a group of type data codes successively for every type pitch movement and thus printing operations for printing places are performed. In a situation where the printing data codes coincide with type data codes to be carried out at substantially the same time, a printing column number limiting circuit is employed in which a means is established for monitoring the number of printing columns and printing is inhibited after the number of printing columns having the coincidence of the printing data codes and the type codes has reached a predetermined number.

The means for monitoring the number of printing columns where such coincidences are obtained is a counter to count coincidence signals concerning the printing data codes and the type codes. The counter is cleared with every type pitch movement. This printing column number limiting circuit is one prior art technique of solving the above-described problem. It is still disadvantageous in one aspect:

In the case where the printing hammer driving period (hereinafter referred to as "a hammer pulse width" when applicable) is longer than one type pitch movement time of the type carrier, the overload of the hammer electric source cannot be positively prevented without reducing the predetermined printing speed.

This is illustrated in FIG. 1. It is assumed that when the count value of the counter counting the number of printing columns where printing data codes coincide with type codes for every type pitch movement reaches a value "N", printing operations for printing columns where such coincidences are obtained thereafter are not carried out. In this case, printing hammers for "N" places become operable whenever a hammer pulse width is equal to one type pitch movement time tc as shown in FIG. 1. If the hammer pulse width is represented by $\tau$, $tc < \tau \leqq 2tc$, the peak value of current flowing in a printing hammer is "I" amperes. The peak value of current supplied by the hammer electric source (hereinafter referred to as "a hammer electric source current" when applicable) may reach $(I \times N \times 2)$ amperes.

In other words, even if the number of columns for the printing hammers which can be driven during one type pitch movement is limited to the value "N", a load of twice the normal is applied to the hammer electric source in the worst case, and therefore, the hammer electric source should have a capacity for withstanding this maximum load.

As indicated, it is rare in normal operation of a printer that the printing hammers for "N" columns are successively driven for every pitch movement. If, under this worst case condition, the number of columns for which the printing hammers can be driven for every type pitch movement is limited to N/2 so that the peak value of the hammer electric source current be smaller than $(I \times N)$ amperes, then the frequency of causing this condition will markedly increased. As a result the printing speed of the system will be considerably decreased.

As the printing speed of the printer is increased, the one type pitch movement time becomes much shorter than the hammer pulse width $\tau$, while the peak value of the hammer electric source current is increased. Accordingly, an increase of the capacity of the hammer driving electric source is required. Thus, this method cannot be satisfactorily applied to a high-speed printer.

SUMMARY OF THE INVENTION

An object of this invention is to eliminate the above-described difficulties accompanying the prior art, and to positively prevent the overload of the hammer electric source and the mechanical overload, independently of the hammer pulse width without decreasing the predetermined printing speed.

It is another object of this invention to provide for a printing limiting device using a counter to ascertain predetermined overload limits and operate the printer at less than the predetermined value.

These and other objects of this invention are carried out using a reversible counter for determining coincidence.

An important aspect of this invention resides in such a reversible counter operating to subject coincidence signals concerning printing data codes and type codes to addition and to subject a printing completion signal for each printing column to subtraction. Hence printing operations of types for columns where printing data codes coincide with type codes after the count value of the counter means has reached a predetermined value are inhibited. The number of printing hammers driven is limited to less than a predetermined value, and the overload of the hammer electric source is positively prevented independently of the hammer pulse width.

The invention will be described with respect to the drawings and the description of the preferred embodiment that follows.

DESCRIPTION OF THE PREFERRED EMBODIMENT

This invention will now be described with reference to its preferred embodiments shown in the accompanying drawings.

Figure 1:
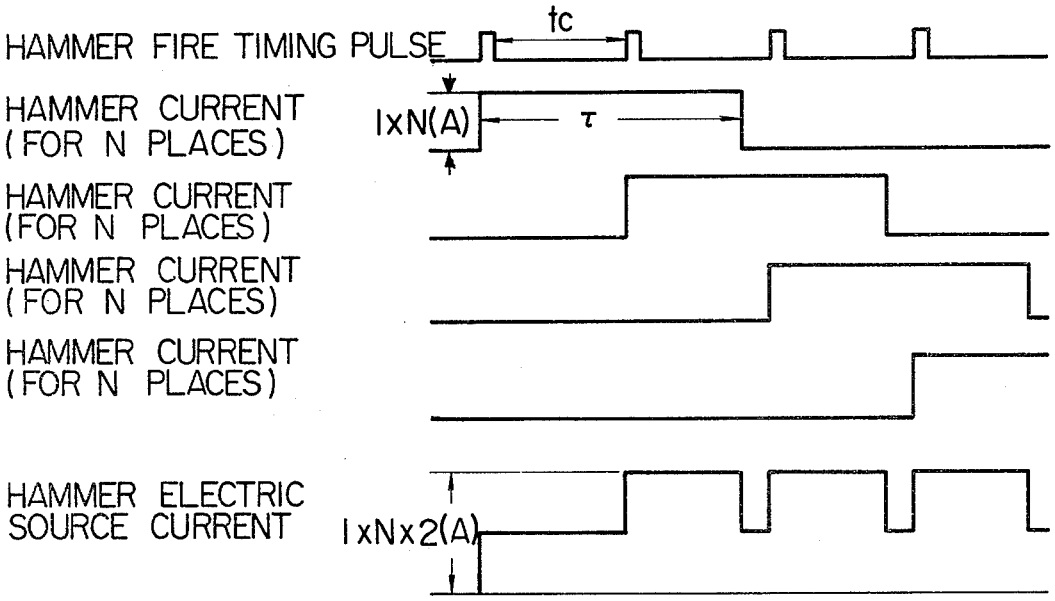
FIG. 1 PRIOR ART
FIG. 1 is a timing diagram for a description of conventional system.
Figure 2:
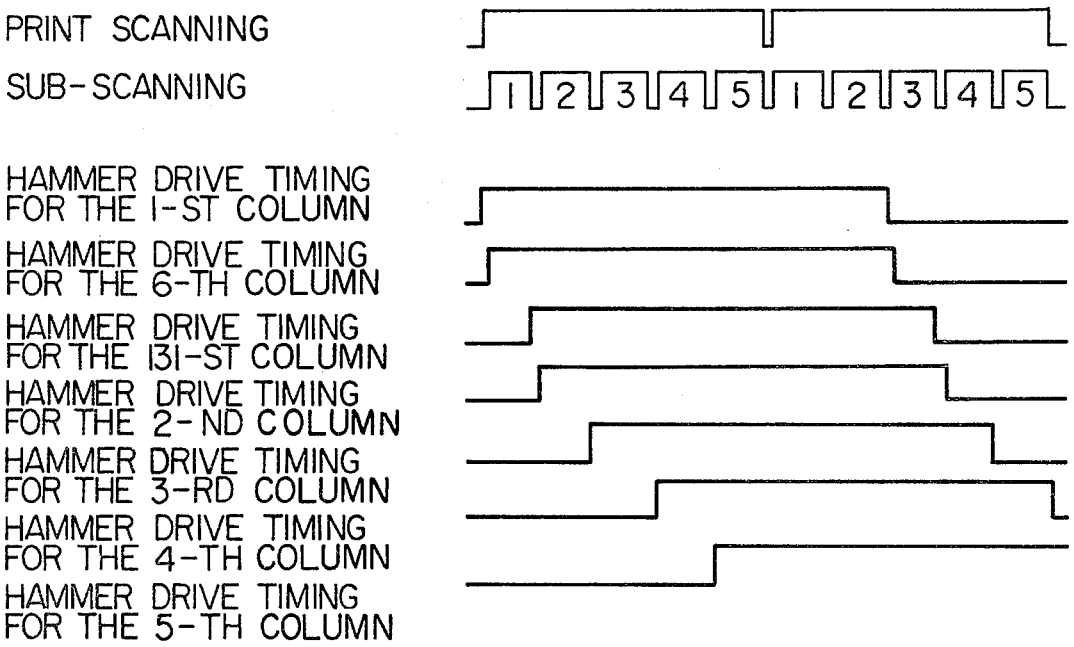
FIG. 2 is a timing diagram indicating a printing system in a printer for this invention.

First, a printing system in a printer suitable for practicing the invention will be briefly described. FIG. 2 is a timing diagram indicating relationships among print scannings, sub-scannings and printing hammer driving timing in a printing operation of a printer having a horizontal type carrier.

The printer carries out a print scanning consisting of five sub-scannings for every type pitch movement, so that print data codes are compared with type codes successively. Upon coincidence, printing hammers for the relevant columns are driven for actual printing. In this printer, the printing hammers and the type are not in a correspondence of 1:1, but in a correspondence of approximately 6:5. Therefore, comparison between a printing data code and a type data code is effected for every five columns in the aforementioned five sub-scannings (which will be referred to as sub-scannings 1 through 5 when applicable). With respect to the columns where comparison is carried out in one and the same sub-scanning, the printing hammers are not always completely confronting the type, and as shown in FIG. 2 all the places are subjected to comparison at different time instants, and the printing hammers are driven at different time instants.

In the aforementioned sub-scanning, the period of time during which the comparison is carried out is divided into first and second parts with respect to a column, so that the print completion timing of each place is controlled in the first part (hereinafter referred to as "a reset cycle" when applicable) while the printing hammer drive starting timing of each column is controlled in the second part (hereinafter referred to as "a set cycle" when applicable). This will collectively control the hammer pulse widths of the printing hammers for all the columns.

Listed below are columns where comparison is effectuated in the sub-scannings. It should be noted that, for instance, 132 columns are provided for one line of printing. The numbers of columns which are read out in the reset cycle are indicated inside the parentheses (), while the numbers of columns which are read out in the set cycle are indicated outside the parentheses (). All of the columns are regularly and successively read out in the directions of the arrows.

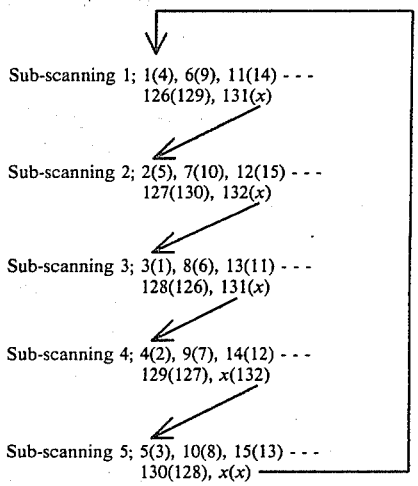

The above-described collective control can be achieved by providing two flag bits for each of the printing data codes transferred from a data source. The flag bits are in a correspondence of 1:1 to the printing data code of each column.

When a printing data code is transferred from the data source, if it is a data code to be printed for each column, then the flag bits $(0\ 0)_2$ are attached to the printing data code.

If it includes no data to be printed, the flag bits $(1\ 1)_2$ are attached to the printing data code. Thereafter, in a printing operation, a printing data code is compared with a type code in the set cycle of each sub-scanning. Upon coincidence, a printing hammer for the relevant column is driven, while the flag bits attached to the printing data code for that column are changed from $(0\ 0)_2$ into $(0\ 1)_2$. The flag bits for the column where the printing hammer has been driven are rewritten into $(1\ 0)_2$ from $(0\ 1)_2$ when they are read out again in the set cycle of a relevant sub-scanning in the following printing scanning. In the reset cycle of each sub-scanning, if flag bits added to a printing data code for a column which has been read out are $(1\ 0)_2$, printing for the relevant columm is carried out while the flag bits are changed from $(1\ 0)_2$ into $(1\ 1)_2$ simultaneously. Thus, the completion of printing one line can be detected from the fact that the flag-bits of the printing data codes for all the columns have been changed to $(1\ 1)_2$ as was described above. In this connection, it should be noted that the operation is effected only when the flag bits are $(1\ 0)_2$ in the reset cycle.

The above-described operation will be described in more detail with reference to the printing hammer.

It is assumed that data to be printed for the first column on a print line are available and flag bits $(0\ 0)_2$ are added to a printing data code for the first column. In the first set cycle in the sub-scanning position 1 of a printing scanning, the first column printing data code is compared with a type code, and upon coincidence the first (1st) column printing hammer is driven, while the flag bits $(0\ 0)_2$ for the 1st column are changed into $(0\ 1)_2$. Therefore, when the 1st column is read out in the first set cycle in the sub-scanning 1 of the next printing scanning, the flag bits $(0\ 1)_2$ are changed into $(1\ 0)_2$. In the first reset cycle in the sub-scanning 3 of the same printing scanning, the 1st column is read out, whereupon printing for the 1st column is carried out, and at the same time the flag bits are rewritten into $(1\ 1)_2$ from $(1\ 0)_2$.

By carrying out the above-described control method for all of the columns, the hammer pulse widths of the printing hammers which are driven at different time increments can be collectively controlled. In the above-described example, the hammer pulse width is equal to seven times a period of time required for one sub-scanning.

Figure 3:
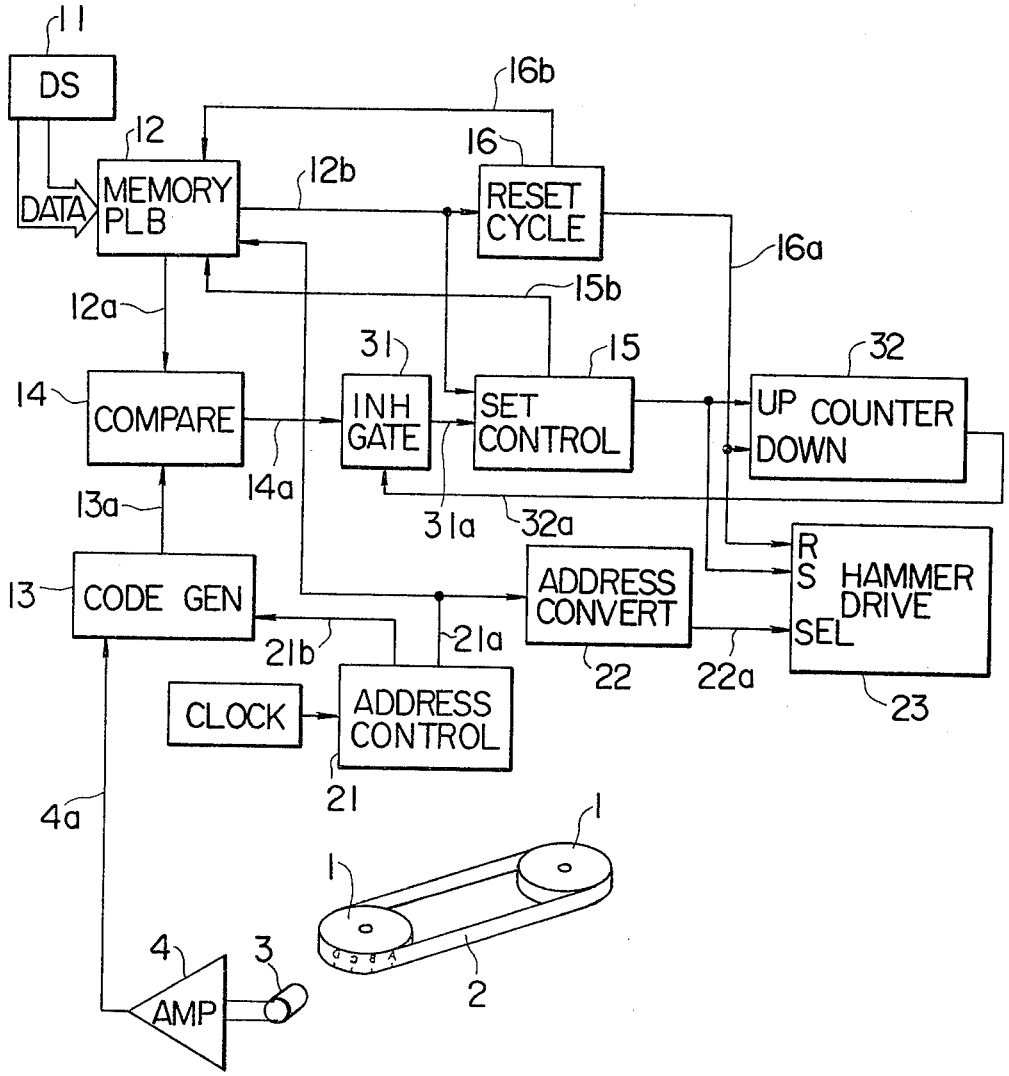
FIG. 3 is a block diagram illustrating one preferred embodiment of this invention.
Figure 4:
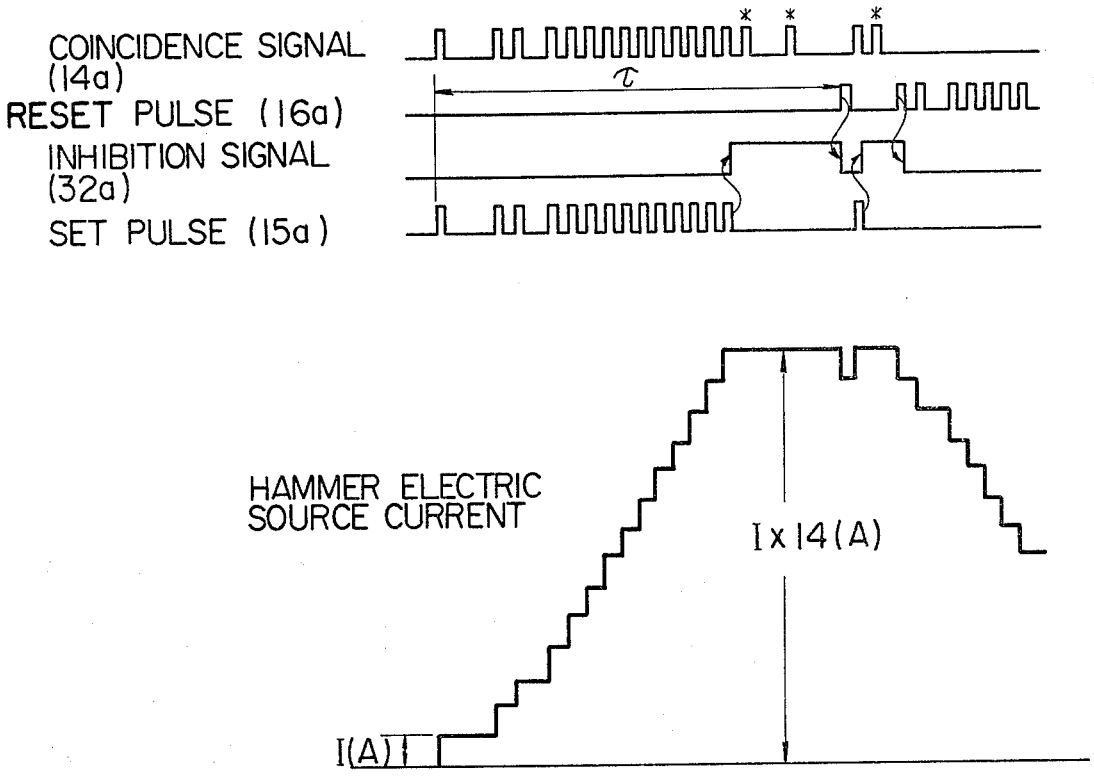
FIG. 4 is a timing diagram of a description of the operation of a printing place number limiting device according to this invention.

Referring now to FIG. 3 a block diagram showing a line printer employing the above-described printing system, to which this invention is applied is shown. FIG. 4 is an explanatory timing diagram of a description of the operation of the line printer shown in FIG. 3.

In the printer, printing data codes for one print line which are delivered from an external data source such as a central processing unit (CPU), are stored in a printing data memory 12. In this case two flag bits for controlling hammer pulse width as described before are added to the printing data code for each column. A mark detector 3 operates to detect marks which are in a correspondence of 1:1 to type on a type carrier 2 which is rotatably run by driving pulleys 1. The detection signal of the detector 3 is applied to an amplifier 4, where it is converted into a control signal which is applied through line 4*a* to a type code generator 13. Thus, a code for a type on the type carrier 2 is held in the type code generator 13 at all times, wherein the type thereon confronts a printing hammer (not shown).

After transfer of the printing data from the data source 11 has been completed, the print scanning comprising the above-described sub-scannings 1 through 5 is started. In accordance with a comparison order, an address control section 21 applies relevant address signals through lines 21*a* and 21*b* to the printing data memory 12 and the type code generator 13 respectively. A uniform data transfer rate is established by using a timing clock input to the address control 21. As a result, the print data code in an address thus specified is delivered through line 12*a* to a comparator 14 from the print data memory 12, while the type data code in an address thus specified is delivered through line 13*a* to the comparator 14 from the type code generator 13. These two codes are then compared in the comparator 14. If they coincide with each other, the comparator 14 generates a coincidence signal on line 14*a* to an inhibition gate 31.

If it is assumed that the inhibition condition is not satisfied and the inhibition gate is therefore open, the coincidence signal is delivered through line 31*a* to a set cycle control section 15 in the form delivered from comparator 14. Upon reception of the coincidence signal, the set cycle control section 15 operates to apply a set pulse to a printing hammer driving section 23.

The address signal applied through the line 21*a* to the printing data memory 12 is also applied to an address converting section 22, from which a column selecting signal is applied through line 22*a* to the selection input terminal of the printing hammer driving section 23. As a result, the relevant column printing hammer is driven.

While carrying out the above-described operation, the set cycle control section 15 causes a reversible counter 32 to count up by "1" and confirms that the flag bits for the relevant column in the printing data memory 12 are $(0\ 0)_2$ through the line 12*b*. Hence a control signal is delivered to the printing data memory 12 on line 15*b* in order to change the flag bits $(0\ 0)_2$ to $(0\ 1)_2$.

When the location where the flag bits have been changed into $(0\ 1)_2$ is read out in the set cycle of the next print scanning, the flag bits $(0\ 1)_2$ are changed into $(1\ 0)_2$ through line 15*b* by the set cycle control section 15. A reset cycle control section 16 operates to discriminate the flag bits for a column read out through the line 12*b* in a reset cycle. If the flag bits are $(1\ 0)_2$, the reset cycle control section 16 applies to reset pulse through a line 16*a* to the printing hammer driving section 23. As a result, the printing operation of the printing hammer for a column which has been selected through the line 22*a* is terminated.

While performing the above-described operation, the reset cycle control section 16 causes the reversible counter to count down by "1". Also it delivers a control signal through line 16*b* to the printing data memory 12, to change the flag bits $(1\ 0)_2$ for the relevant column in the printing data memory 12 into $(1\ 1)_2$.

When the count value of the reversible counter 32 reaches a predetermined value N while repeating the above-described count-up and count-down operations, the reversible counter 32 produces an inhibition signal which is applied through line 32*a* to the inhibition gate 31 to close the gate.

Therefore, even if a coincidence signal relating to a printing data code and a type code is thereafter delivered to the inhibition gate 31 through line 14*a*, the coincidence signal is not provided on line 31*a*. Therefore, the printing hammer is not driven and the flag bits $(0\ 0)_2$ are maintained unchanged. This state is maintained as long as the count value of the reversible counter 32 is maintained at the predetermined value N. In a particular example, the predetermined value N is fourteen (14). The timing diagram of FIG. 4 is to explain an operation of this invention in the case of $N=14$.

If it is assumed that the count value of the reversible counter 32 is "O" in FIG. 4, no inhibition signal (32*a*) is provided. If, under this condition, a coincidence signal relating to a printing data code and a type code is provided, a set pulse is generated. As a result, the above-described predetermined printing operation is carried out. Thereafter, when fourteen set pulses, namely, fourteen coincidence signals are produced before the first reset pulse is generated, the count value of the reversible counter 32 has a value "14", and the inhibition signal (32*a*) is provided. Accordingly, even if a coincidence signal is generated thereafter, no set pulse is provided. In other words, even if coincidence signals marked with (*) in FIG. 4 are produced, no set pulse is provided. If however one reset pulse is provided from reset cycle control 16, the count value of the reversible counter 32 reaches "13", and therefore the effect of inhibition signal (32*a*) is released. A set pulse is provided if a coincidence signal is available. However, as the count value of the reversible counter 32 reaches "14" upon receipt of a set pulse from control 15, the inhibition signal (32*a*) again controls operation.

Accordingly, the peak value of hammer electric source current never exceeds $(14\times I)$ amperes as indicated in FIG. 4, if the peak value of current flowing in a printing hammer coil for one column is "I" amperes. This value is held independently of a hammer pulse width. It is obvious that the reversible counter 32 is cleared after the completion of the printing cycle or before the start of the next printing cycle.

In order to prevent the over-load of the hammer electric source in the printer, it is important to limit the peak current value to lower than a predetermined value as well as to limit the average current value. If the peak value of the hammer electric source current is limited, the variation in line drop in a path through which a printing hammer coil is reduced and the variation in voltage across a printing hammer coil is also reduced. Therefore, the limitation of the peak value of the hammer electric source current can effectively prevent the printing displacement which may be caused by the variation in flight time of a printing hammer.

Heretofore, it is impossible to limit the peak value of the hammer electric source current, if the hammer pulse width has a certain value. However, according to this invention, the average current value and peak current value of the hammer electric source can be positively and effectively controlled independently of the hammer pulse width.

Figure 5:
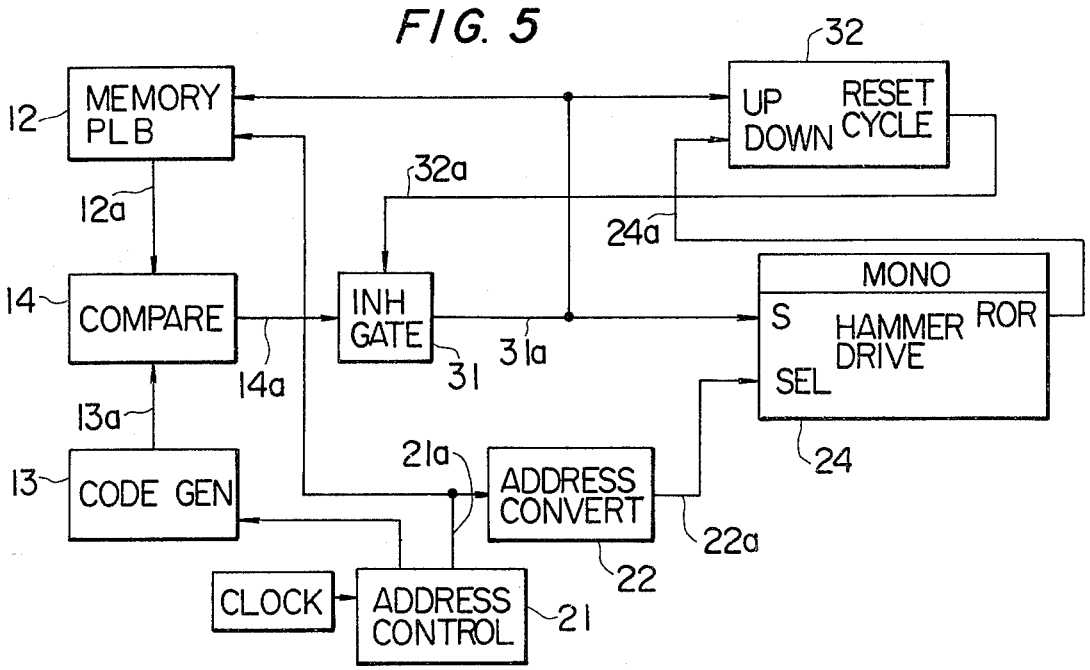
FIG. 5 is a block diagram showing another preferred embodiment of this invention.

Referring now to FIG. 5 another embodiment of this invention is shown. FIG. 5 is a block diagram illustrating a printer in which a printing hammer driving section 24 has a time limit device such as a monostable-multivibrator for each hammer driving circuit and to which the technical concept of this invention is applied. In the embodiment in FIG. 5, the printing hammer driving section 24 receives through line 31*a* only a set pulse which determines printing hammer drive starting timing. The print completion timing is set by time limiter provided in the hammer driving circuits, respectively.

A process of producing a coincidence signal on line 14*a* is similar to that in the above-described embodiment of FIG. 3 and therefore the description of this process is omitted. In the embodiment shown in FIG. 5, the judgement as to whether or not the printing hammer for each column has been driven is achieved by adding one flag bit to a printing data code in printing data memory 12 or by rewriting, when a printing hammer is driven, the relevant column printing data code into a blank code.

The printing hammer driving section 24 operates to apply a pulse generated at the time of completion of operation of the time limit device for each column, or a printing completion signal ROR, through line 24*a* to the count-down input terminal of a reversible counter 32. A coincidence signal passed through an inhibition gate 31 is applied through line 31*a* to the count-up input terminal of the reversible counter 32. As a result the counter 32 is counted up. While the count value of the reversible counter 32 is maintained at a predetermined value N, an inhibition signal is provided on a line 32*a* by the reversible counter 32. The other operations are similar to those in the above-described first embodiment, however as shown the reset cycle control section 16 is eliminated.

It is apparent that other modifications of this invention are possible without departing from the essential scope of the invention.

We claim:

1. In a printer having a type carrier, a data storage means having stored therein a printing data code, a sensor to determine the instantaneous position of type on said carrier and a comparator for comparing said printing data code with the instantaneous position of said type and generating a drive signal to a hammer drive mechanism to effectuate a printing operation, said printer having a control system for limiting the number of printing operations which may be effectuated at any one time, the improvement comprising:

reset means for generating reset signals to terminate a printing operation;

reversible counter means for maintaining a count value therein, said reversible counter means increasing said count value in response to each said drive signal and decreasing said count value in response to each said reset signal; and means for inhibiting said drive signals when the value in said counter means is in excess of the maximum permissible number of simultaneous printing operations.

2. The printer of claim 1 further comprising means for storing a series of address signals indicative of print type data codes, code generator means receiving the outputs of said sensor and said means for storing address signals and generating an output indicative of the address of the sensed instantaneous type position.

3. The printer of claims 1 or 2 further comprising address converting means for generating an input to said hammer drive mechanism to select a relevant printing hammer to be driven when said drive signal is received.

4. The printer of claim 1 further comprising an inhibit gate disposed between said comparator and said hammer drive mechanism, said inhibit gate receiving the output of said reversible counter means and inhibiting transfer of drive signals to said hammer drive mechanism when said total reaches said predetermined value.

5. The printer of claim 4 further comprising means responsive to the output of said inhibit gate for providing an input to said counter to increase the count value in said reversible counter means, and for generating a signal to said data storage means to indicate the generation of a drive signal.

6. The printer of claim 5 wherein the reset signal generated by said reset means is coupled to said hammer drive mechanism to terminate selection of a print hammer, said reset means generating a reset signal in response to a signal from said data storage means indicating that a hammer has been driven.

7. The printer of claim 4 wherein said reset means to generate a reset signal comprises time limit means coupled to said hammer drive mechanism for generating a reset signal to said reversible counter means at the end of a print operation.

8. The printer of claim 2 further comprising clock means coupled to said means for storing a series of address signals.

* * * * *